US005568836A

United States Patent [19]

Reid

[11] Patent Number: 5,568,836

[45] Date of Patent: Oct. 29, 1996

[54] RELEASE DEVICE FOR RELEASABLY COUPLING A FIRST OBJECT TO A SECOND OBJECT

[75] Inventor: Michael A. Reid, Aberdeen, Scotland

[73] Assignee: Well-Equip Limited, Aberdeen

[21] Appl. No.: 464,389

[22] Filed: Jun. 5, 1995

[30] Foreign Application Priority Data

Jun. 6, 1994 [GB] United Kingdom ..... 9411270

[51] Int. Cl.[6] ..... E21B 34/10

[52] U.S. Cl. ..... 166/65.1; 166/72; 166/237

[58] Field of Search ..... 166/381, 382, 166/237, 240, 319, 322, 65.1, 72

[56] References Cited

U.S. PATENT DOCUMENTS

| | | | |
|---|---|---|---|
| 4,423,782 | 1/1984 | Bowyer | 166/321 |
| 4,432,417 | 2/1984 | Bowyer | 166/120 |
| 4,650,010 | 3/1987 | George et al. | 175/4.52 |
| 4,856,585 | 8/1989 | White et al. | 166/323 |
| 4,949,793 | 8/1990 | Rubbo et al. | 166/382 |
| 5,156,207 | 10/1992 | Haugen et al. | 166/142 |
| 5,158,142 | 10/1992 | Miszewski et al. | 166/377 |
| 5,191,936 | 3/1993 | Edwards et al. | 166/297 |
| 5,236,048 | 8/1993 | Skinner et al. | 166/382 |

*Primary Examiner*—Frank Tsay
*Attorney, Agent, or Firm*—Ratner & Prestia

[57] ABSTRACT

A release device for releasably coupling a first object to a second object includes a first member (10) adapted to be coupled to the first object and a second member (20) adapted to be coupled to the second objects. A latch mechanism (12, 21, 28) releasably couples the first member (10) to the second member (20). A time delay mechanism (22, 23, 24, 26, 27) permits the latch mechanism (12, 21, 28) to decouple the first and second members (10, 20) only after a time interval has elapsed from initiation of the decoupling of the first and second member (10, 20).

12 Claims, 2 Drawing Sheets

RELEASE DEVICE FOR RELEASABLY COUPLING A FIRST OBJECT TO A SECOND OBJECT

The present invention relates to a release device and particularly, but not exclusively, to a release device to enable a wireline to be released from a wireline tool.

BACKGROUND OF THE INVENTION

Wireline operations are carried out in oil and gas wells on a regular basis. Wireline is used to convey a toolstring down hole to perform setting or retrieving tasks. A wireline toolstring comprises a combination of different pieces of equipment screwed together to form a working unit. This unit is manipulated from the surface via the wireline which can be made to perform either upward or downward jarring by either reeling in or reeling out wire from the winch.

Pressure control equipment is attached to the well-head which will include a "stuffing box" and a "blow-out preventer". This equipment is used to seal against the wire while running into or out of the hole, and to seal against the wire in emergency situations respectively.

The wire is attached to the toolstring by means of a "rope socket" which is essentially a wire clamp.

Situations occur from time to time when the toolstring becomes stuck downhole. When this happens the only way to recover the wire from the well is by attaching at the surface a "cutter tool" which will slide down the wire, cutting on impact at the rope socket. Time is lost when attaching this cutter tool as the blow out preventer has to be sealed across the wire to hold back well pressure while the tool is attached to the wire. Another disadvantage is that the cutter tool may cut the wire prematurely if it hits a restriction on its way downhole.

SUMMARY OF THE INVENTION

According to the present invention there is provided a release device for releasably coupling a first object to a second object, the release device comprising a first member adapted to be coupled to the first object, a second member adapted to be coupled to the second object, a latch mechanism to releasably couple the first member to the second member, and a time delay mechanism permitting the latch mechanism to decouple the first and second members only after a time interval has elapsed from the initiation of the decoupling of the first and second members.

Preferably, the latch mechanism is movable between a first position, in which the first and second members are coupled together, and a second position, in which the first and second members are free to decouple.

Preferably, the time delay mechanism is a speed regulating mechanism, provided so that the speed at which the latch mechanism may move to the second position is less than the speed at which the latch mechanism may move to the first position.

Preferably, the speed regulating mechanism comprises a fluid filled chamber, first and second portions of the chamber being separated by a movable piston member with a bore between the first and second portions, the bore containing a valve device to permit fluid to flow at a relatively rapid rate from the first portion to the second portion, and fluid flows at a relatively slow rate from the second portion to the first portion.

Preferably, the piston member includes another bore. Typically, the valve device allows a relatively rapid rate of flow of fluid from the first portion into the second portion, but substantially no flow from the second portion into the first portion, and the other bore in the piston member includes a flow regulator device to permit only a relatively slow rate of flow of fluid through the other bore.

Preferably, the fluid comprises a hydraulic fluid.

Preferably, said latch mechanism comprises a latch member movably located on one of the first and second members which, in the first position engages a recess in the other of the first and second members, and in the second position is permitted to disengage from the recess.

Typically, the release device is adapted for use where there is, in normal use, a tensile force frequently applied between the first object and the second object substantially axially to the movement of the latch mechanism and in a direction from the second to the first position.

Preferably, the tensile force which occurs in use biases the latch mechanism to the first position.

Preferably, a biasing device is included to bias the latch mechanism to the second position.

Preferably, the biasing device exerts a biassing force which is less than the tensile force which is exerted between the first and second members in use.

Typically, the biasing device comprises a spring.

Preferably, the release tool is adapted for use where the first object is a rope socket, a wireline, coil tubing or electricline, or another wireline, coil tubing or electricline tool and the second object is a wireline, coil tubing or electricline tool or toolstring.

Preferably, the minimum tensile force is the weight of the tool or tools located below the release device acting on the latch mechanism, in use.

Preferably, the initiation of the decoupling of the first and second members is achieved by setting down the weight of the second object to remove the tensile force between the first and second members or to reduce the tensile force below the minimum tensile force and the biassing force exerted by the biassing device.

BRIEF DESCRIPTION 0F THE DRAWINGS

Examples of a release device according to the present invention will now be described, by way of example, with reference to the accompanying drawings in which.

DESCRIPTION OF PREFERRED EMBODIMENTS

Figure 1:
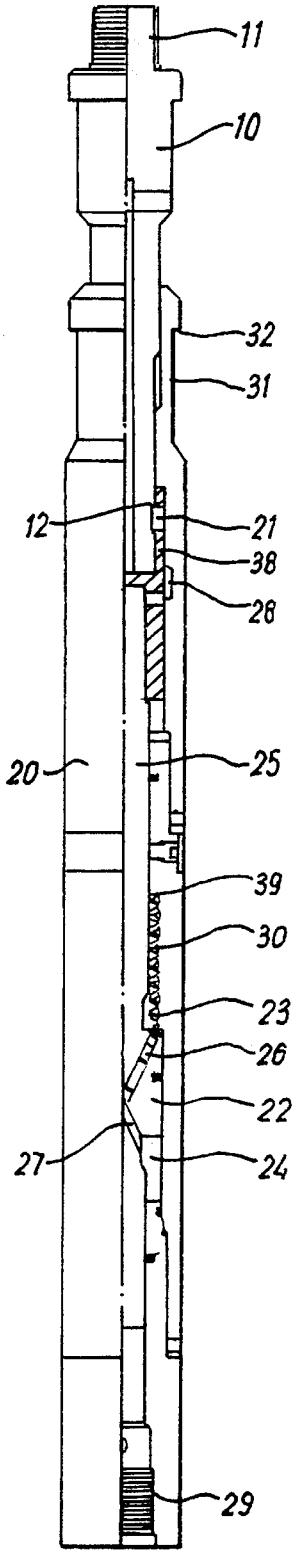
FIG. 1 shows a partial cross-sectional view of a first example of a release device for wireline under normal conditions.

With reference to FIG. 1 a release device for use in connecting a wireline to a toolstring comprises a releasable portion 10 and a generally cylindrical main body 20, the releasable portion 10 having an upper screw threaded portion 11 which, in use, would be attached to a rope socket (not shown). The releasable portion 10 extends inside the main body 20 and is provided with a groove 12 near to the end which extends into the main body 20.

A piston member 22 is slidably coupled to, and housed in the main body 20 which separates two portions 23, 24 of a chamber filled with hydraulic oil. A piston rod member 25 attached to the piston member 22 extends towards the part of the releasable portion 10 which is inside the main body 20.

The piston rod member 25, adjacent its end nearest the releasable portion 10, is coupled to a retaining member 38 which retains a dog 21. The dog 21 as shown in Fig. 1 is located in the groove 12 in the releasable portion 10. In this way the piston member 22 is coupled to the removable portion 10.

The piston member 22 has two bores 26, 27 extending between the two fluid filled portions 23, 24. Although, for illustrative purposes, both bores 26, 27 are shown in the sectional view, the bores are distinct and do not interconnect. One of these bores 26 includes a one way valve which allows the hydraulic fluid to flow rapidly from the upper portion 23 to the lower portion 24 of the chamber but does not allow flow of fluid from the lower portion 24 to the upper portion 23. The other bore 27 includes a metering device and allows a low rate of fluid flow in either direction.

A spring 30 is inside the main body 20 and is located in contact with both a shoulder 39 provided in the wall of the casing of the main body 20 and the piston member 22 in order to provide a downwards biasing force to the piston member 22. The internal wall of the main body 20 is provided with a groove 28 suitably configured to be able to accept the dog 21.

The main body 20 is also provided at its lower end with an internally threaded portion 29 so that the release device can be attached to a tool string (not shown) at its lower end.

Figure 2:
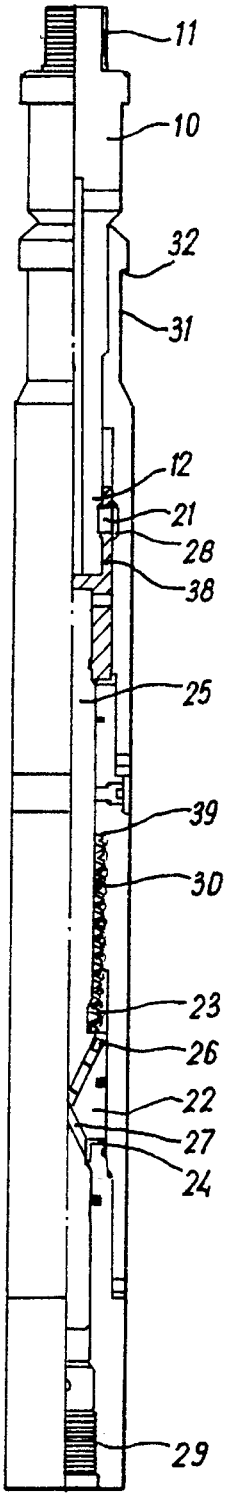
FIG. 2 shows a partial cross-sectional view of the release device of FIG. 1 ready for the release to occur.
Figure 3:
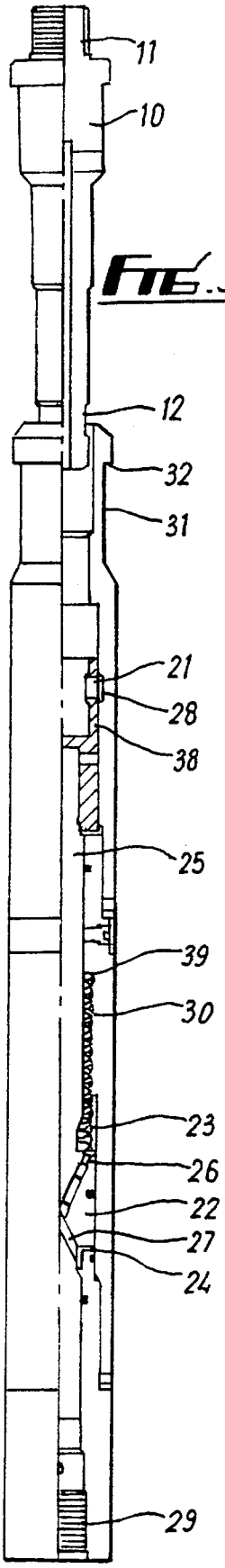
FIG. 3 shows a partial cross-sectional view of the release device of FIGS. 1 and 2 after release.

FIGS. 2 and 3 are part-sectional illustrations of the release device of FIG. 1 in different configurations corresponding to different stages of the release process, and corresponding parts have therefore been allocated corresponding reference numerals.

In normal use, that is with the release device coupled at its upper end to a wireline (not shown) and at its lower end to a toolstring (not shown) suspended on the wireline the configuration of the device will be substantially as illustrated in FIG. 1. The releasable portion 10 is slidably coupled to the main body 20 and the weight of the toolstring (not shown) provides tension which would tend to pull the releasable portion 10 and the main body 20 apart. The releasable portion 10 and main body 20 cannot, however, be pulled apart because the dog 21 is located in the groove 12 in the releasable portion 10, preventing the grooved part of the releasable portion 10 from being able to pass through the constricted opening at the top of the main body 20. The proximity of the wall of the main body 20 prevents the dog 21 from moving in its aperture in the retaining member 38 so as to escape from the groove 12.

The spring 20 provides a biasing force which would tend to force the piston member 22 downwards thus pulling the releasable portion 10 further into the main body 20. However, the weight of the toolstring (not shown) provides a considerably greater force than that applied by the spring and this overcomes the biasing force preventing the piston member 22 from being forced downwards. Thus when a toolstring is suspended and the weight of the toolstring is taken by the wireline, the releasable portion 10 is securely coupled to the main body 20.

During wireline operations the toolstring will be landed off for short periods of time eg downward jarring, resetting jars etc. When this happens the weight of the toolstring may no longer exert a large downward force on the device. In this case the piston member 22 may begin to move downwards, thus allowing the dog 21 to approach the groove 28 in the main body 20. (which would eventually lead to the release of the releasable portion 10 from the main body 20).

However, the piston can only move very slowly in the downwards direction since the bore 26 permits no transmission of oil from the lower portion 24 to the upper portion and the bore 27 allows only a very slow rate of flow. Thus, if the release of weight from the wireline is for only a relatively short time the piston member will not have time to move sufficiently, because of the downwards force of the biasing spring 30 plus the rope socket weight, to allow the dog 21 to reach the groove 28 in the main body 20, and the releasable portion 10 will not be released. Once the toolstring is again freely suspended by the wireline the piston member 22 can move rapidly back to its original position since the bore 26 allows rapid flow of fluid from the upper portion to the lower portion of the chamber.

If the toolstring becomes stuck it is desirable to release the releasable portion 10, attached to the wireline (not shown), from the main body 20 of the release device. When the toolstring is stuck its weight is not operating on the release device and slight slackening of the wireline releases the remainder of the tension from the device and allows the bias force provided by the spring 30 to become the dominant force in positioning the piston member 22. The piston member will thus move downwards with respect to the main body 20 of the device. This downwards motion will be slow because as discussed above, the hydraulic fluid may pass only very slowly through the bore 27 in the piston member from the lower portion 24 to the upper portion 23 of the chamber.

As the piston member 22 moves downwards the releasable portion 10 also moves downwards with respect to the main body 20 and the dog 21 located in the groove 12 moves towards the groove 28 in the main body 20 of the device. FIG. 2 shows the configuration of the device when the piston member 22 has reached its lowest position. At this point the groove 12 in the releasable portion 10 and the dog 21 constrained in this groove 12, have reached the groove 28 in the main body 20. The dog 21 can thus move into the space provided by the groove 28 in the main body 20 and is no longer constrained in the groove 12 in the releasable portion 10.

The secure coupling of the releasable portion 10 to the main body 20 was, as described above, due to the dog 21 being constrained in the groove 12 and thus preventing the part of the releasable portion 10 with the groove from passing through the restricted opening in the main body 20. The coupling of the piston member 22 via the piston rod member 25, retaining member 38 and dog 21 to the releasable portion 10 was also due to the dog 21 being located in the groove 12. When the dog 21 is no longer constrained in the groove 12, the releasable portion 10 may therefore be removed from the main body by exerting an upward force on the releasable portion 10. This upward force would be exerted simply by reeling in the wire line using a winch.

FIG. 3 illustrates the removal of the releasable portion 10 from the main body 20. The dog 21 is located in the groove 28 in the main body 20 and does not hinder the removal of the releasable portion.

The main body 20 is provided at its upper end with a narrow portion 31 and at the upper end of the narrow portion 31 a shoulder 32. This configuration provides a "fishing neck" facilitating the retrieval of the main body and attached tool string by a suitable tool after the removal of the releasable portion, rope socket and wireline from the well.

This embodiment of the present invention thus provides a release device which may be easily provided between a rope socket and a tool string and in which the release of the wireline may be achieved simply by bottoming out the tool string, slackening the wireline, allowing the tool string to remain bottomed out for a predetermined time, and then winding in the wireline along with the rope socket and the releasable portion of the device. The time period for which the tool string must remain bottomed out in order to effect release is determined by the rate at which the hydraulic fluid may flow upwards through the piston member. A period of about 30 minutes has been found to be convenient, being a sufficiently short period to avoid undue loss of time, but a sufficiently long period to avoid accidental release if the tool string is temporarily landed off.

Figure 4:
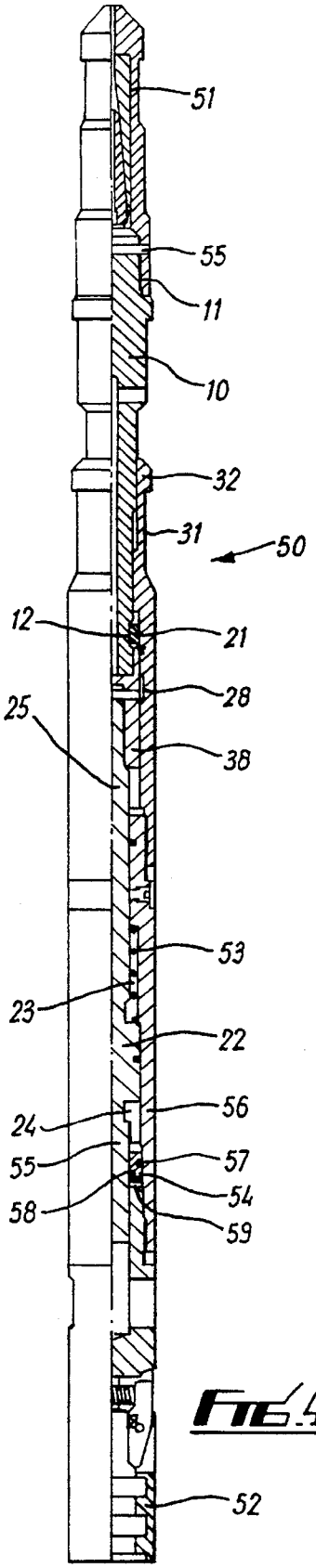
FIG. 4 is a partial cross-sectional view of a second example of a release device for wireline; and, FIG. 5 is a partial cross-sectional view of an example of a release device for electricline.

FIG. 4 is a partial cross-sectional view of a second example of a release device 50 for coupling a wireline (not shown) via a rope socket 51 to a toolstring coupled to the lower end of the release device 50 via a female TRINITY (trade mark) quick lock connector 52.

The release device 50 is similar to the release device shown in FIGS. 1 to 3 but with a few minor modifications. Parts which are identical to the release device shown in FIGS. 1 to 3 are indicated using the same reference numerals as in FIGS. 1 to 3.

The release device 50 differs from the release device shown in FIGS. 1 to 3 in that in the release device 50 a helical spring 53 is provided in place of the spring 30. The other difference is that movable member 54 is provided between lower rod member 55 and a piston chamber body 56. Seal 57 seals the member 54 between the piston body 56 and the movable member 54, seal 58 seals between the movable member 54 and the lower piston body 55 and seal 59 provides a lower stop for the movable member 54.

Figure 5:
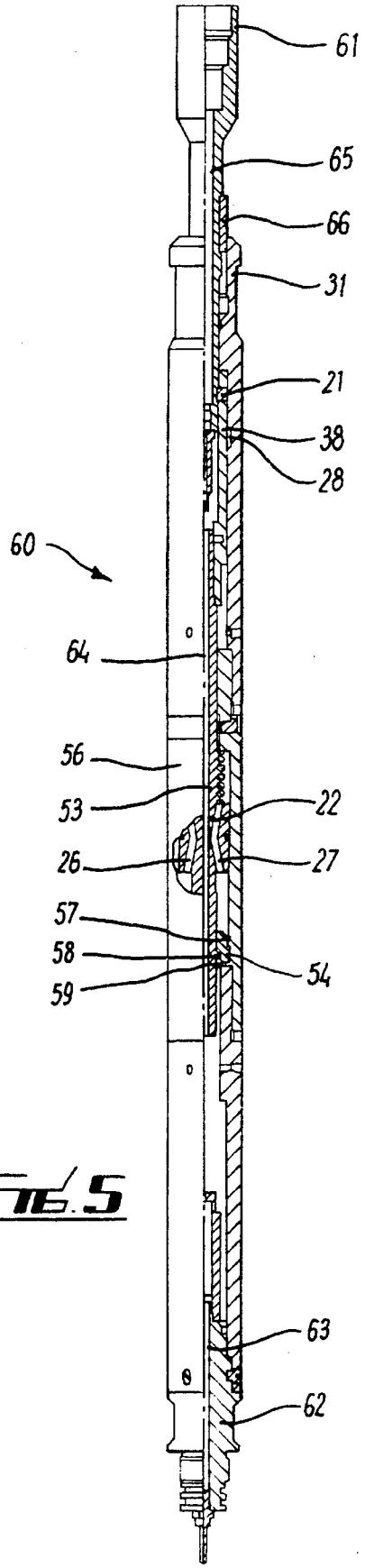

The advantage of the movable member 54 is that it permits compensation of the internal pressure within the chambers 24, 23 with the external pressure in the wellbore. This helps prevent any problems arising due to differences in pressure, particularly across a seal 58 which could result in energising of the seal 58 and an increase in friction between the seal 58 and the lower rod member 55. By use of the floating member 54, instead of the seal 58 being energised, the movable member 54 moves in response to pressure differences to compensate for the increase in pressure as hole depth increases. FIG. 5 shows an example of a release device 60 for use in electricline. The operation of this tool is virtually identical to the release devices 50 and the device shown in FIGS. 1 to 3, the primary difference between the device 50 and the device 60 is that the device 60 is provided with connection means to permit electricline to be passed through the centre of the device 60 so that electricline above the device 60 may be electrically coupled to an electricline toolstring below the device 60. To facilitate this, the device 60 is provided with an upper connector 61 for connection to an electicline (not shown), and a lower connector 62 for connection to electricline tools below the release device 60. A throughbore 63, 64, 65 is provided to permit electrical coupling of the electricline coupled to the connector 61 to the lower connector 62. Furthermore, the connector 61 is also provided with a key 66 which engages with a slot in a fishing net 31 which prevents rotation of the connector 61 with respect to the lower connector 62.

The invention has the advantage of eliminating the need to drop a cutting tool down the wireline and this mitigates the problems associated with such cutting tools.

I claim:

1. A release device for releasably coupling a first object to a second object, the release device comprising a first member adapted to be coupled to the first object, a second member adapted to be coupled to the second object, a latch mechanism to releasably couple the first member to the second member, and a time delay mechanism permitting the latch mechanism to decouple the first and second members only after a time interval has elapsed from the initiation of the decoupling of the first and second members.

2. A release device according to claim 1, wherein the latch mechanism is movable between a first position, in which the first and second members are coupled together, and a second position in which the first and second members are free to decouple.

3. A release device according to claim 1, wherein the time delay mechanism is a speed regulating mechanism, whereby the speed at which the latch mechanism may move to the second position is less than the speed at which the latch mechanism may move to the first position.

4. A release device according to claim 3, wherein the speed regulating mechanism comprises a fluid filled chamber, first and second portions of the fluid filled chamber being separated by a movable piston member with a bore between the first and second portions, the bore containing a valve device to permit fluid to flow at a relatively rapid rate through the bore from the first portion to the second portion.

5. A release device according to claim 4, wherein the piston member includes another bore, wherein the valve device substantially prevents fluid flow through the one bore from the second portion to the first portion, and the other bore includes a flow regulator device to permit only a relatively slow rate of fluid flow through the other bore from the second portion to the first portion.

6. A release device according to claim 2, wherein the latch mechanism comprises a latch member movably located on one of the first and second members which, in the first position engages a recess in the other of the first and second members, and in the second position is permitted to disengage from the recess.

7. A release device according to claim 2, wherein the weight of the second object moves the latch mechanism to the first position when the release device is supported by the first member.

8. A release device according to claim 7, and further comprising a biassing device to bias the latch mechanism to the second position, wherein the biassing force exerted by the biassing device is less than the weight of the second object.

9. A release device according to claim 7, wherein decoupling of the first and second members is initiated by setting down the weight of the second object to remove the weight of the second object or reduce the weight of the second object on the release device.

10. A toolstring for lowering into a borehole, the toolstring comprising a flexible member, a plurality of tools coupled to the end of the flexible member and a release device for releasably coupling a first tool on the toolstring to a second tool on the toolstring, the release device comprising a first member adapted to be coupled to the first tool, a second member adapted to be coupled to the second tool, a latch mechanism to releasably couple the first member to the second member, and a time delay mechanism permitting the latch mechanism to decouple the first and second members only after a time interval has elapsed from the initiation of the decoupling of the first and second members.

11. A toolstring according to claim 10, wherein the flexible member comprises a line of wire.

12. A toolstring according to claim 10, wherein the flexible member comprises an electric conductor.

* * * * *